United States Patent [19]

Crawford

[11] 4,163,406

[45] Aug. 7, 1979

[54] CENTERING DEVICE FOR FEEDING ARTICLES TO A FOOD SLICER

[75] Inventor: Lynn D. Crawford, San Jose, Calif.

[73] Assignees: Genevieve I. Hanscom; Genevieve I. Hanscom, Robert M. Magnuson, Lois J. Thomson, Trustees of the Estate of Roy M. Magnus, all of Calif.

[21] Appl. No.: 860,865

[22] Filed: Dec. 15, 1977

[51] Int. Cl.[2] ..... B26D 7/06

[52] U.S. Cl. ..... 83/424; 83/435.2; 83/425.2; 144/246 F; 83/437

[58] Field of Search ..... 83/435.2, 425, 425.2, 83/424, 423, 437, 404.1, 435, 404.2; 144/246 F, 39, 41, 312

[56] References Cited

U.S. PATENT DOCUMENTS

| | | | |
|---|---|---|---|
| 993,173 | 5/1911 | Karhu | 83/435.2 |
| 1,878,423 | 9/1932 | Nowlin | 83/435.2 |
| 2,684,088 | 7/1954 | Miller | 144/41 |
| 2,722,256 | 11/1955 | Hise | 83/424 |
| 2,897,859 | 8/1959 | Annis | 144/246 F |

*Primary Examiner*—Donald R. Schran
*Attorney, Agent, or Firm*—Gerald L. Moore

[57] ABSTRACT

A feed apparatus for conveying articles to a rotary cutter for cutting the articles lengthwise into segments. To obtain nearly equal sized segments while cutting randomly sized articles, the feed apparatus receives the articles one at a time between feed belts spaced radially about the cutter center line. These belts are supported to move radially outward in unison to accommodate each article thereby aligning the articles with the cutter center line prior to cutting.

6 Claims, 8 Drawing Figures

CENTERING DEVICE FOR FEEDING ARTICLES TO A FOOD SLICER

BACKGROUND OF THE INVENTION

Food products such as pickles, carrots and the like frequently are split lengthwise during the processing operation. One type of slicer suitable for this purpose is described in U.S. Pat. No. 3,848,498 identified herein. In this apparatus the product is fed into a cutter comprising a plurality of power-driven rotary blades positioned to extend radially inward towards a common center line so as to segment the product lengthwise.

As recognized in this previous patent, the individual products vary in size and if not fed such that each product's longitudinal axis coincides with the cutter center line, the segments resulting from the cut will be unequal in size. In fact with only a slight variance in article size there will result some small slivers from each article cut because the cut center line will be near one surface of the article. Naturally such cuts result in waste and in a less attractive appearance in the case of pickles and the like.

In the patent previously mentioned, there was provided means for manually varying the relative positions of the power-driven disc blades and the feeding means so as to alter the relative height and angle between the cutter center line and the article feed line thereby to enable regulation of the configuration of the segments resulting from these sliced articles. While such adjustments made manually are effective if the articles being cut are of uniform size, there still exists the problem of cutting articles of random sizes during the same run. A partial solution to this problem involves grading the articles by size, however this is a time-consuming and expensive operation.

It is the purpose of the present invention to provide a feed device for use with slicers to automatically center articles of varying sizes so that the segments resulting from the cut will be near equal size.

SUMMARY OF THE INVENTION

A feed apparatus for use with a rotary slicer or the like comprising a plurality of feed belts mounted for rotation in planes extending radially outward from the slicer center line. The belts are power-driven to receive the articles and propel them forward into the slicer. Each belt is individually mounted for movement radially outward from the cutter center line and is interconnected such that movement of any one belt will cause a like movement of all other belts. Thus as the articles enter the feed apparatus, the belts are forced outward by each article to a position allowing room for passage of the article in alignment with the center line of the slicer so that the article will be sliced into equal size segments.

DESCRIPTION OF THE INVENTION

Figure 1:
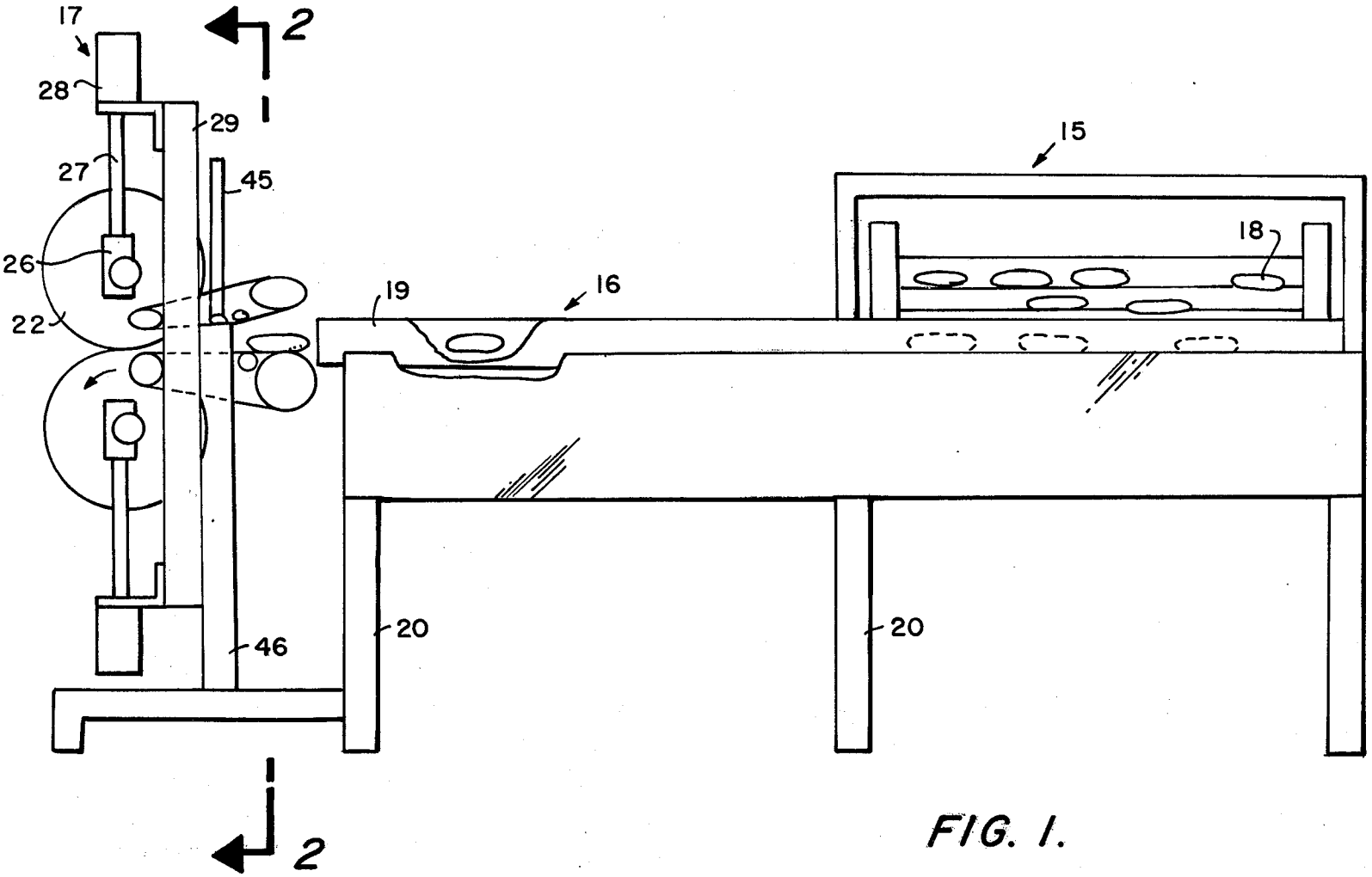
FIG. 1 is a side view of apparatus incorporating the subject invention for feeding and slicing articles such as vegetables.

In the apparatus shown in FIG. 1 produce such as pickles and the like can be fed in single-file order for slicing. The apparatus incorporates a shuffle feed apparatus 15 for feeding articles to a conveyor belt 16 for movement through a slicing apparatus 17. The shuffle feed apparatus can be of the type disclosed in U.S. Pat. No. 3,923,143, Shuffle Feeder Capable of Single-File Advancement of Articles, issued on Dec. 2, 1975, with Chester Green as inventor. An example of a conveyor mechanism is disclosed in U.S. Pat. No. 3,848,498, identified previously, which also discloses a rotary slicer suitable for use in the apparatus shown in FIG. 1. Thus the articles 18 are fed from a supply (not shown) to fall in rows between the feed belts 19 supported on legs 20 for movement from right to left in the drawing towards the cutting station.

The rotary slicer 17 includes a plurality of power-driven blade assemblies 21 (FIGS. 2 and 3) each comprising a disc blade 22 secured by a lock nut 24 to a shaft 25 extending from a gear box 26. The gear box is driven through a shaft by a motor 28.

Each blade assembly 21 is bolted to a frame 29 extending around the feed path of the product being sliced. In this manner the blades are positioned in planes coinciding with the feed center line 30 and extend radially outward therefrom at equal angles relative to each other. Thus the product is carried along the feed belts 19 to the cutting area of the blades 22. In this manner each article is cut into longitudinal segments for additional processing or canning.

In accordance with the present invention, there is provided an apparatus for receiving the product from the conveyor 16 and for feeding it into the rotary slicer 17 such that the longitudinal axis of the product coincides substantially with the center line of the slicer. In this manner the segments resulting from the slicing of the produce are of substantially equal size.

Figure 2:
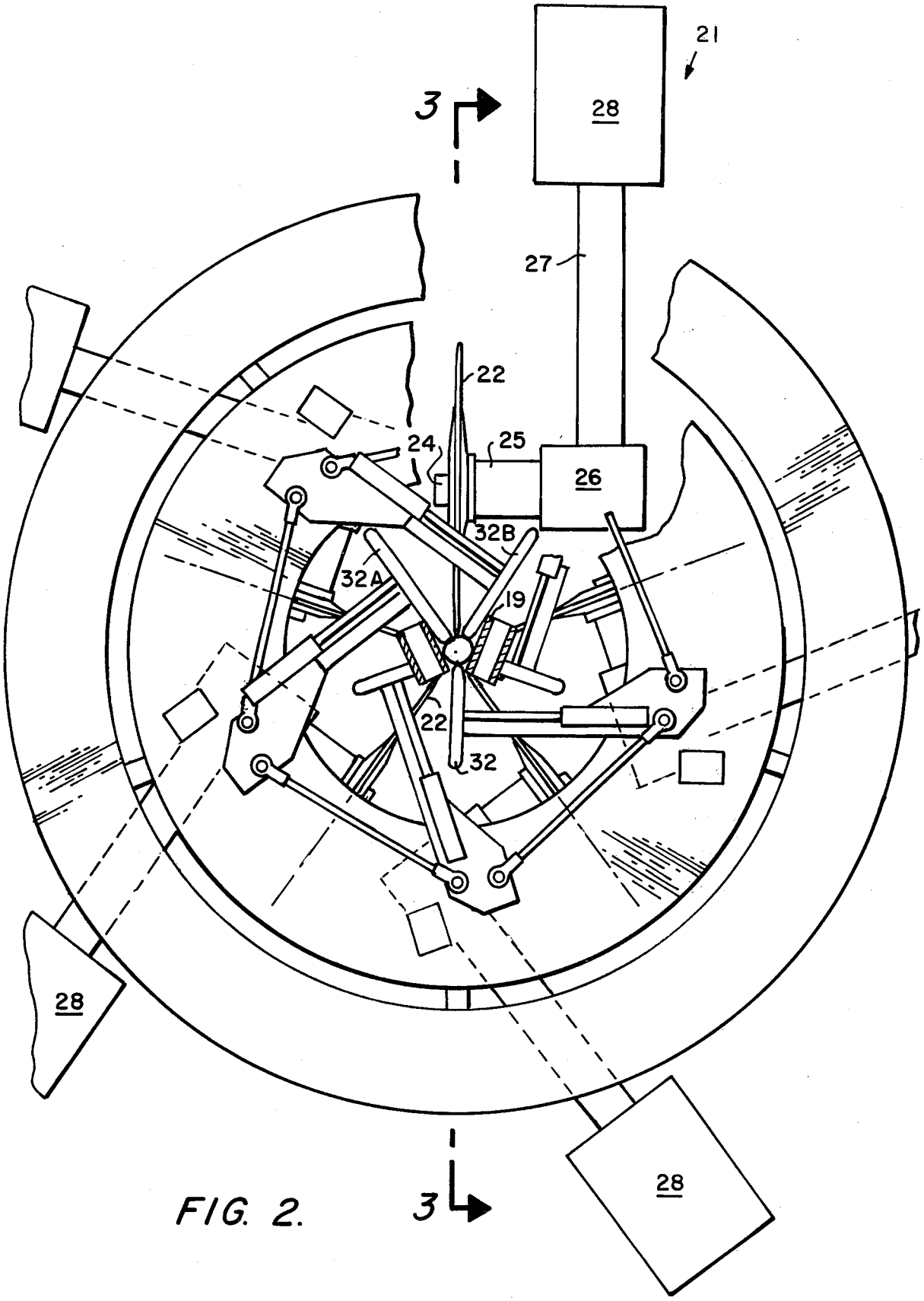
FIG. 2 is an enlarged cross-sectional and partially cut away view along the line 2—2 of FIG. 1.
Figure 3:
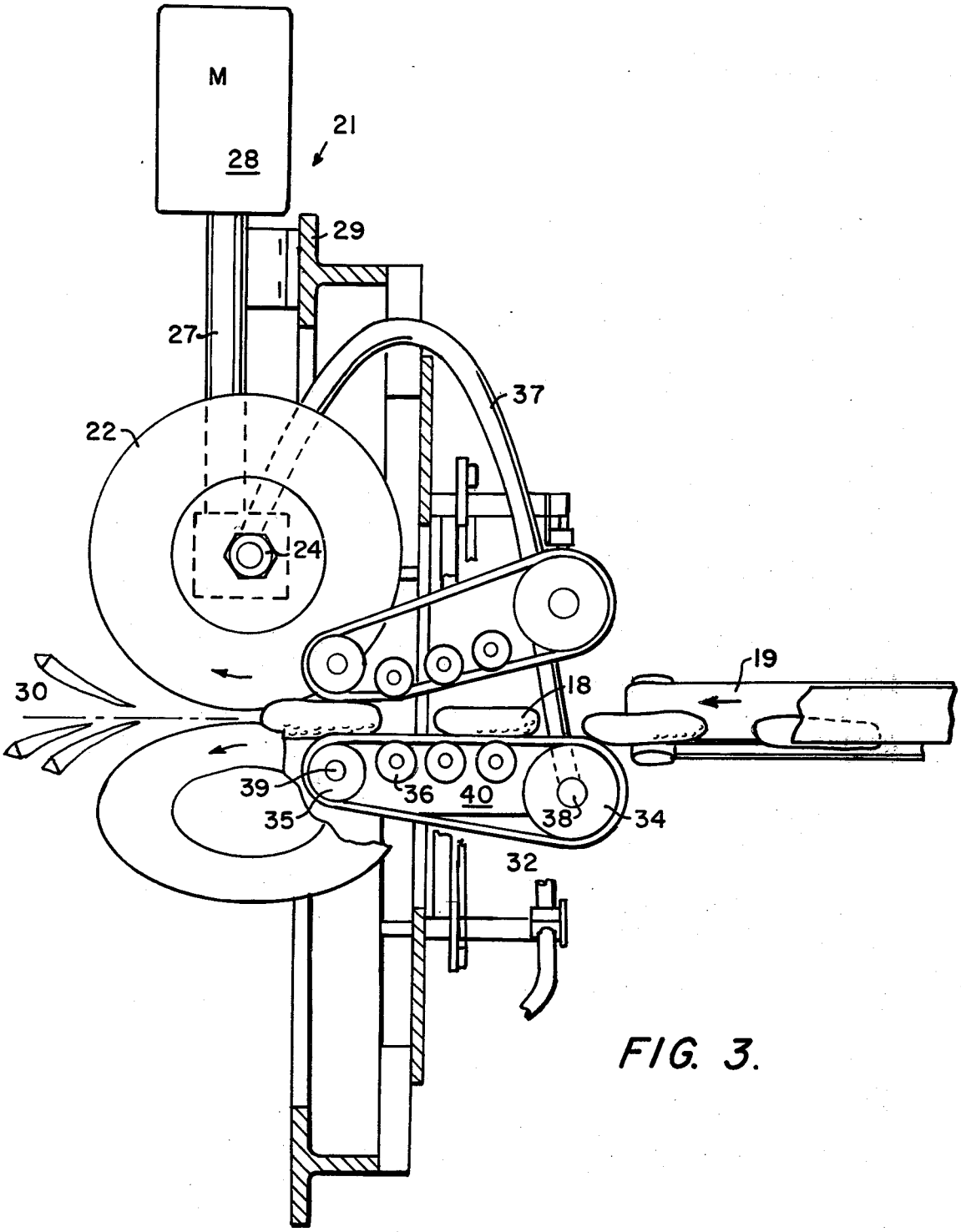
FIG. 3 is a cross-sectional view along the line 3—3 of FIG. 2.
Figure 4:
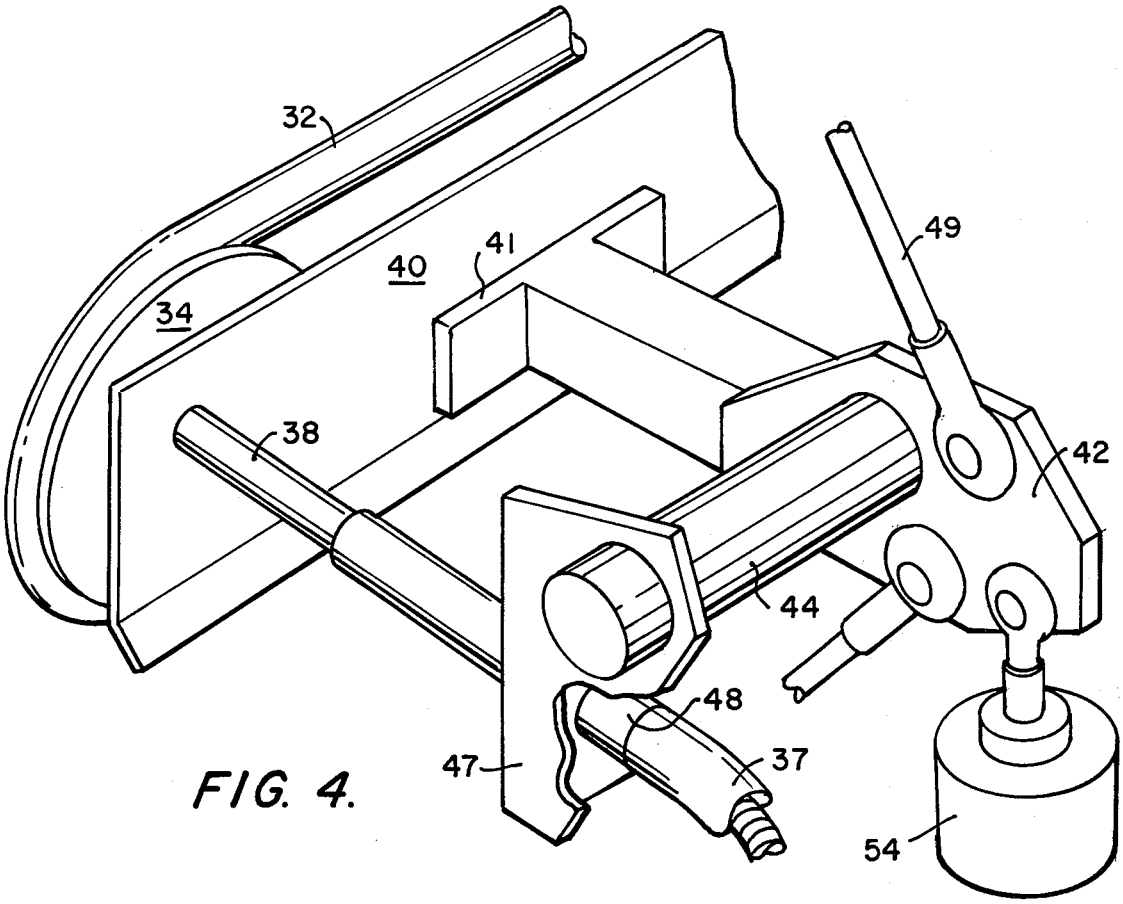
FIG. 4 is an enlarged perspective view of a portion of one feed belt mechanism.

Accordingly as shown primarily in FIG. 2, there is provided a feed belt 32 positioned between each of the rotary cutting blades 22 with means to support these belts for rotation so as to receive the product from the conveyor 16 and carry it into the plane of the rotary cutters. As shown primarily in FIG. 3, each feed belt 32 is supported by a feed belt support mechanism including a power-driven pulley 34 near the belts 19 and a pulley 35 at the cutter end. Positioned between these pulleys and adjacent the inward portion of the belt next to the center line 30 and contacting the product to be sliced, are a plurality of intermediate support pulleys 36, three in number in this embodiment, which pulleys press against the inside of the belt for support of the articles riding along the belt.

For driving the drive pulley 34 there is attached to the nut 24 on the opposite rotary cutter 22 a flexible drive shaft 37 which extends down and attached to a support shaft 38 on which the pulley 34 is mounted. Thus with rotation of the rotary cutter, the feed belt 32 is powered in the correct direction for feeding the articles into the cutter.

The drive pulley 34 and support pulley 35 are fixed respectively to the shafts 38 and 39 journaled on a frame member 40 extending generally in a plane parallel to the plane of the feed belt 32. This frame member in turn is attached, preferably by welding, to a support arm 41 extending normal thereto and to a support plate 42 journaled on a stub shaft 44. The stub shaft 44 is in turn fixed to an annular support frame 45 supported on the frame 29.

Figure 5:
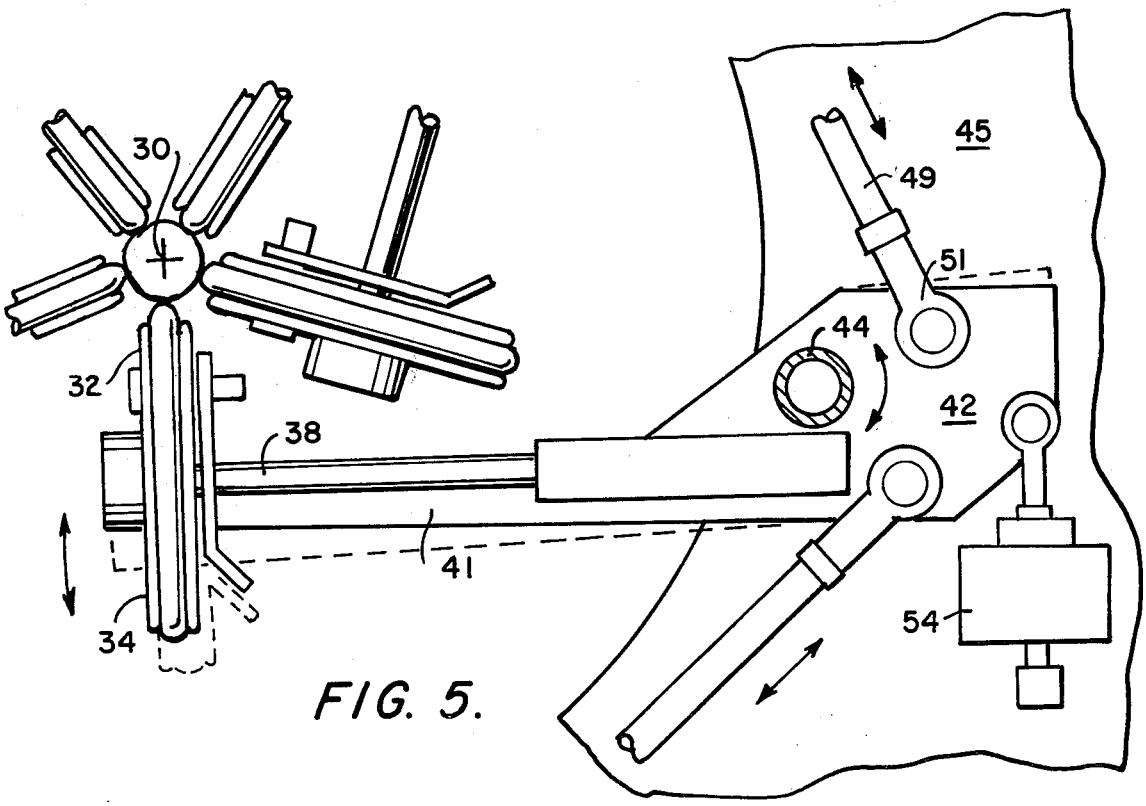
FIG. 5 is a rear view of one feed belt mechanism.

Thus as can be seen primarily in FIG. 5, rotation of the support plate 42 about the stub shaft 44 causes the supported drive belt to be moved radially outward to the dotted line position substantially in radially extending planes extending outward from the center line. Because of the length of the support arm 41, the outward movement is substantially in a plane extending from the cutting center line 30 of the rotary cutter. While it is realized that such movement is actually arcuate about the center of the stub shaft 44, still for purposes of the present invention such movement sufficiently approximates a radial movement. A bracket 47 fixed to the stub shaft also supports the coupling 48 connecting the drive shaft 38 and the flexible drive member 37.

Connecting each of the support plates 42 with the next adjacent support plates is a linkage assembly formed of connecting rods 49 journaled on the plates by pivotal connections 50 and 51 at the ends. Thus rotation of any one of the support plates about the supporting stub shaft 44 will result in a similar movement of all of the support plates. Because of the length of the support arm 41, i.e., the distance between the feed belt 32 and the stub shaft 44, in comparison with the distance between the same stub shaft and the connections 51, any slight pressure outward on a feed belt 32 results in rotation of all the support plates 42.

Figure 6:
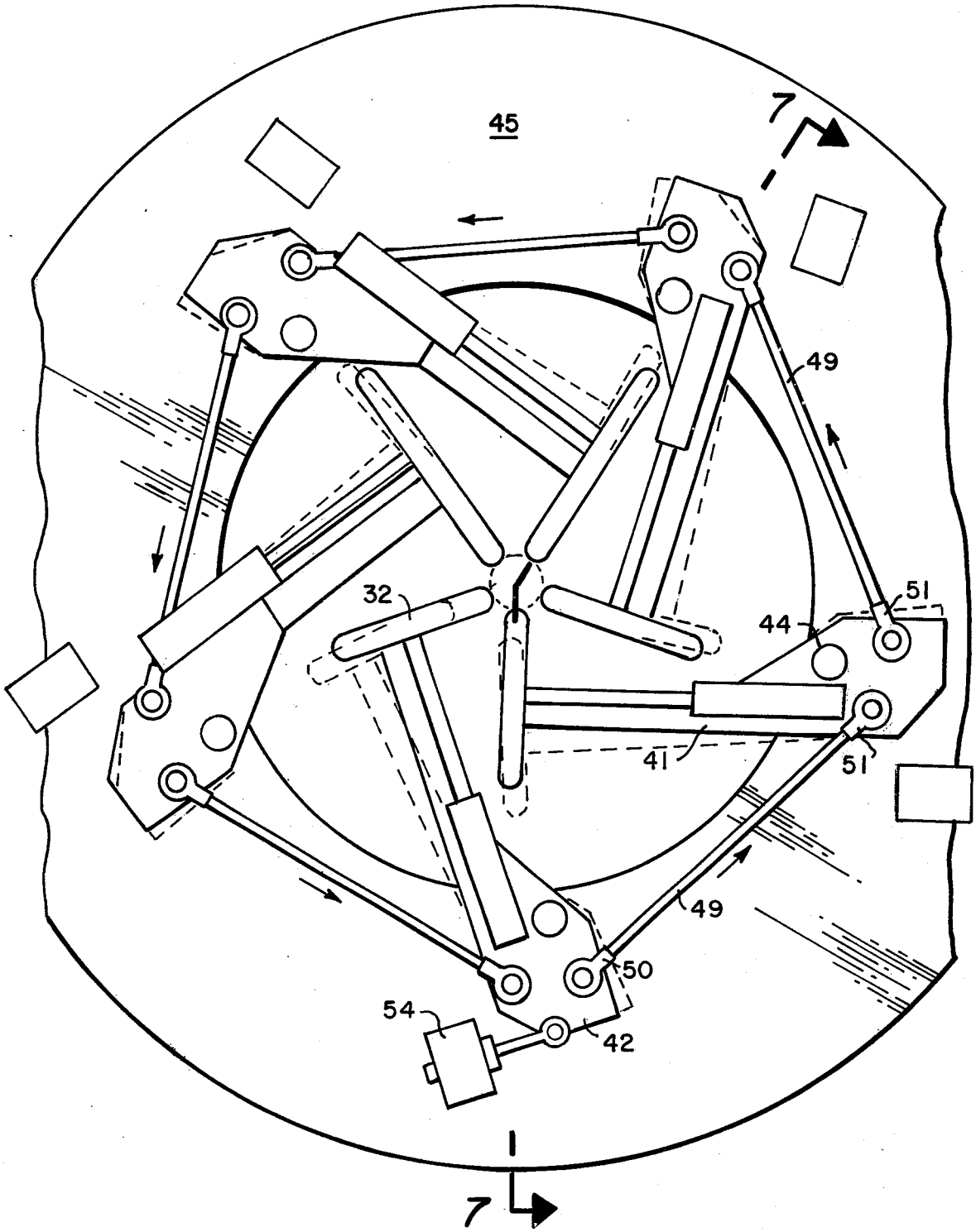
FIG. 6 is a rear view of the feed belt mechanisms showing the manner of movement of the feed belts.
Figure 7:
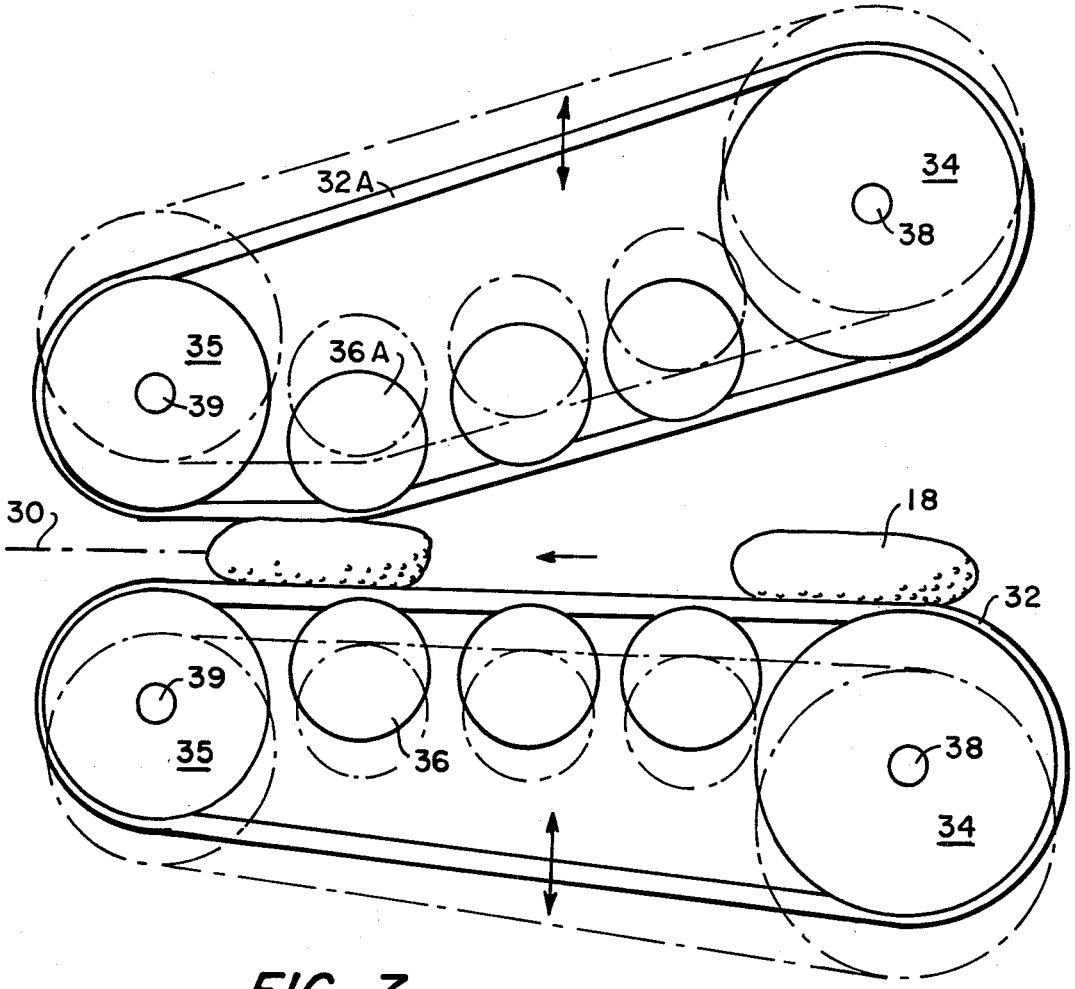
FIG. 7 is a cross-sectional view along the line 7—7 of FIG. 6.

Thus as shown in FIGS. 6 and 7, when the product 18 reaches the drive pulleys 34, each article comes to rest on the bottom feed belts which in the present instance are three feed belts, one positioned directly below the feed center line and the other two being positioned at an angle of 72° therefrom since there are five feed belts spaced equally around the feed center line. As shown in FIG. 7, the top two feed belts 32A and 32B (FIG. 2) are mounted in a manner such that the inward belt portion does not extend parallel to the article feed path. In other words the pulley 34 is positioned further away from the feed path center line than the pulley 35 such that the belt 32A extends over the first pulley 36A and thereafter bends away from the feed center line 30 such that a line extending along the belt inward portion forms an acute angle with the center line. Thus the product 18 is carried on the lower belts 32 until it comes into contact with the upper two belts 32A and 32B at which time a camming action is effected causing all of the belts and support means therefor to move radially outward to accommodate the cross-section of the article. Since movement by any one of the belts with result in movement of all of the belts, the belts move radially outward an equal distance to maintain the product longitudinal axis centered on the feed center line 30 so as to enter the radial cutters near the center thereof for slicing the article into equal segments. By configuring the top two belts 32A and 32B in the manner described, a camming action is effected on the belts to facilitate movement thereof under the force of the product being handled. The product is supported adequately on the bottom belts since the inward portion thereof extends parallel to the feed path to render sufficient support area to hold the article. Of course if more or fewer belts are utilized, preferably only those on top are configured like belts 32A and 32B.

Figure 8:
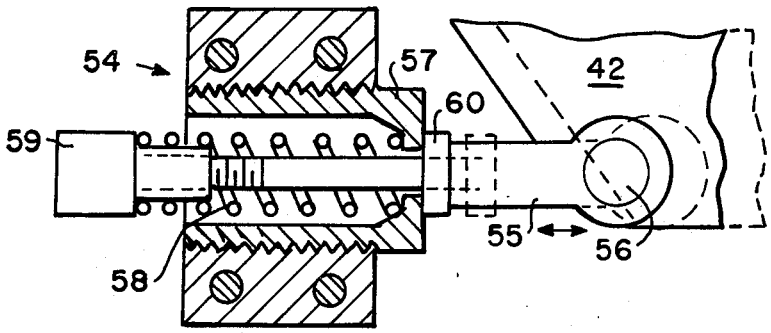
FIG. 8 is a cross-sectional view of the adjusting and bias means for the feed belt mechanism.

In accordance with another feature of the invention, the belts are spring-loaded radially inward towards the article path by a bias means 54 (FIGS. 5 and 8). This bias means comprises a connecting arm 55 pivotally attached around a bolt 56 fixed to the support plate 42. Positioned within a bracket 57 is a compression spring 58 which extends to a nut 59 screwed on the shaft 55. Thus the spring 58 tends to push the shaft from right to left in FIG. 8 which tends to move the drive belts 32 radially inward. The bracket 57 is mounted on the frame of the machine.

Movement of the feed belts 32 radially inward continues until a nut 60 threaded onto the shaft 55 between the bracket 57 and the bolt 56 abuts the bracket 57 forming a stop means. By adjustment of the nut 60 the position of the belts 32 can be set. Also adjustment of the nut 59 changes the tension on the spring 58 to vary the spring bias on the feed belt assemblies. It is desirable that the feed belts be positioned so as to be contacted by the smallest of the articles to be cut so as to always feed forward and center the articles as they enter the cutting plane of the rotary cutters. Adjustment of the spring tension will depend upon how solid or firm the articles are.

The invention claimed:

1. A feed apparatus for use with a slicer having a plurality of power rotated blade assemblies mounted to converge on a common center line and segment articles fed along the center line at the infeed side of said blade assemblies, comprising in combination:

a plurality of feed belts held on spaced pulleys;

support means for each of said pulleys mounting each belt with an inward portion extending adjacent said center line at the infeed side of the blade assemblies and the remainder of each said belt extending radially outward therefrom;

a linkage assembly connecting said support means for moving each support means in unison substantially in a radially extending plane passing through said center line;

bias means for biasing said support means towards the center line; and drive means including a flexible drive shaft connecting a power rotated blade assembly with a feed belt for rotating each belt about the supporting spaced pulleys in a direction to carry articles contacting the inward belt portion towards the blade assemblies whereby the articles will be held between the belts and the belt support means will be moved radially outward by contact with the article to center the article on the center line of the blade assemblies

2. A feed apparatus as defined in claim 1 wherein some of said belt inward portions are positioned to extend parallel to said center line.

3. A feed apparatus for use with a slicer having a plurality of power rotated blade assemblies mounted to converge on a common center line and segment articles fed along the center line at the infeed side of said blade assemblies, comprising in combination:

a plurality of feed belts held on spaced pulleys;

support means for each of said pulleys mounting each belt with some belts having an inward portion having a part thereof extending adjacent and parallel to said center line at the infeed side of the blade assemblies and a part thereof extending along a line forming an acute angle with said center line and the remainder of each said belt extending radially outward therefrom;

a linkage assembly connecting said support means for moving each support means in unison substantially in a radially extending plane passing through said center line;

bias means for biasing said support means towards the center line; and drive means for rotating each belt about the supporting spaced pulleys in a direction to carry articles contacting the inward belt portion towards the blade assemblies whereby the articles will be held between the belts and the belt support means will be moved radially outward by contact with the article to center the article on the center line of the blade assemblies.

4. A feed apparatus as defined in claim 3 including stop means to limit the inward travel of the feed belts towards the center line.

5. A feed apparatus as defined in claim 4 wherein the stop means is adjustable.

6. A feed apparatus as defined in claim 5 wherein said drive means is a drive shaft extending from the power rotated blade assemblies to one of the spaced pulleys.

* * * * *